US010626004B2

(12) United States Patent
Trettin et al.

(10) Patent No.: US 10,626,004 B2
(45) Date of Patent: Apr. 21, 2020

(54) FRONT PUSH TAP

(71) Applicant: David S. Smith America, Inc., Lester Prairie, MN (US)

(72) Inventors: Bradley L. Trettin, Buffalo Lake, MN (US); Ronald E. Kieras, Woodstock, IL (US)

(73) Assignee: David S. Smith America, Inc., Lester Prairie, MN (US)

( * ) Notice: Subject to any disclaimer, the term of this patent is extended or adjusted under 35 U.S.C. 154(b) by 0 days.

(21) Appl. No.: 16/047,214

(22) Filed: Jul. 27, 2018

(65) Prior Publication Data

US 2019/0031490 A1 Jan. 31, 2019

Related U.S. Application Data

(60) Provisional application No. 62/538,119, filed on Jul. 28, 2017.

(51) Int. Cl.
*B67D 3/00* (2006.01)
*B67D 3/04* (2006.01)

(52) U.S. Cl.
CPC ..... *B67D 3/0058* (2013.01); *B67D 3/046* (2013.01)

(58) Field of Classification Search
CPC ..... B67D 3/043; B67D 3/044; B67D 3/046; B67D 3/0058
USPC ..... 222/509, 511, 518
See application file for complete search history.

(56) References Cited

U.S. PATENT DOCUMENTS 1,066,178 A * 7/1913 Bonnell ..... B60K 15/04 137/588
3,368,923 A 2/1968 Smith
3,595,445 A * 7/1971 Buford ..... B65D 47/2025 222/213
4,452,425 A * 6/1984 Lucking ..... F16K 21/04 220/724
4,471,807 A * 9/1984 Lucking ..... B67D 3/043 137/614.12
5,337,775 A * 8/1994 Lane ..... B65D 77/067 137/68.29
6,446,845 B1 * 9/2002 Steiger ..... B67D 3/043 222/105

(Continued)

FOREIGN PATENT DOCUMENTS

WO WO-2015179614 A1 * 11/2015 ..... B67D 3/045
WO 2016035102 A1 3/2016

*Primary Examiner* — Vishal Pancholi
(74) *Attorney, Agent, or Firm* — Vidas Arrett & Steinkraus P.A.

(57) ABSTRACT

A front push tap dispenser has a flow configuration and a sealed configuration. The tap comprises a tap body, a spring button member and a valve seal member, with the two members connected by a flexible stem having two ends, each end connected to the spring button member and the valve seal member. When in the sealed configuration the spring button holds the flexible stem and the valve seal member so the valve seal member is sealingly engaged to the inner wall of the dispensing port. When in the flow configuration the spring button is depressed, which causes the flexible stem and the valve seal to move downwardly to unseal the dispensing port to allow fluid to be dispensed. When the spring button is released, it elastically springs back to the undepressed position, causing the valve seal member to sealingly engage with the inner wall of the dispensing port.

17 Claims, 15 Drawing Sheets

(56) References Cited

U.S. PATENT DOCUMENTS

| | | | | |
|---|---|---|---|---|
| 8,402,999 | B2 * | 3/2013 | Nini | B67D 3/044 137/588 |
| 2002/0079001 | A1 | 6/2002 | Blackbourn et al. | |
| 2004/0164079 | A1 | 8/2004 | Alois | |
| 2008/0078970 | A1 * | 4/2008 | Craft | F16K 15/18 251/144 |
| 2010/0282345 | A1 | 11/2010 | Richards et al. | |
| 2015/0069094 | A1 * | 3/2015 | Maher | B65D 11/22 222/511 |
| 2016/0010858 | A1 | 1/2016 | Cadeau et al. | |
| 2017/0190562 | A1 | 7/2017 | Trettin | |

* cited by examiner

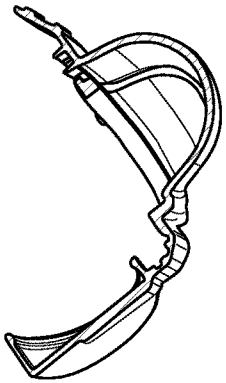
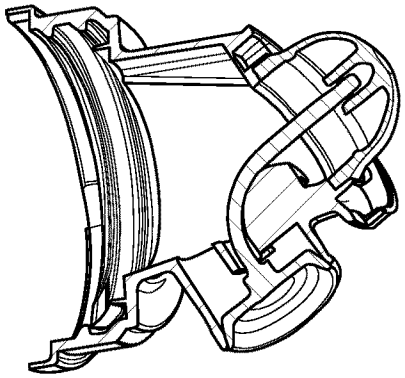
FIG. 11C
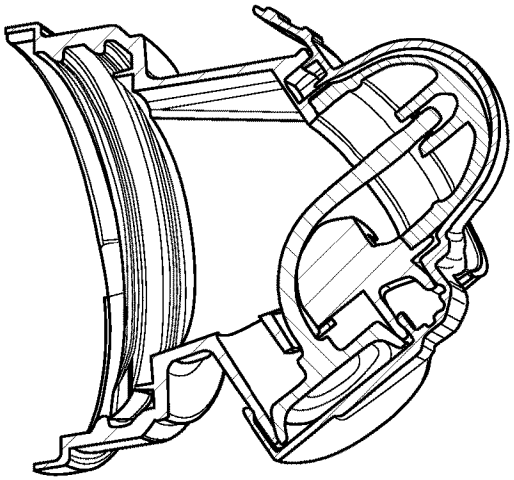
FIG. 11B
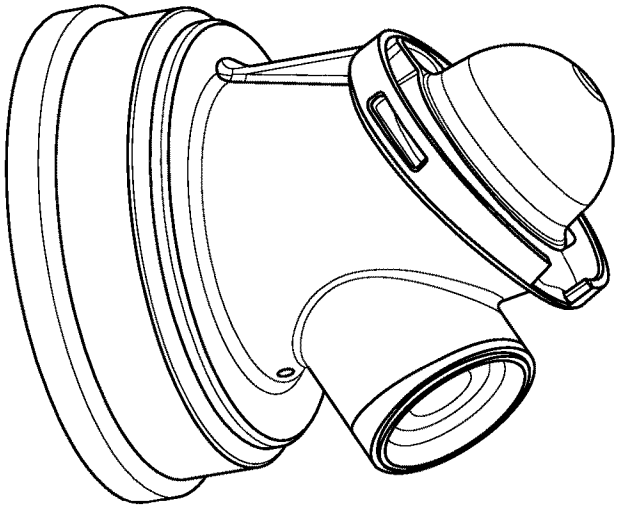
FIG. 11A

FRONT PUSH TAP

CROSS-REFERENCE TO RELATED APPLICATIONS

This Application claims the benefit of and priority to U.S. Provisional Application No. 62/538,119, filed Jul. 28, 2017, the entire contents of which are herein incorporated by reference.

STATEMENT REGARDING FEDERALLY SPONSORED RESEARCH

Not Applicable.

BACKGROUND OF THE INVENTION

Heretofore, various types of fluid dispensers have been developed to dispense fluid from various types of containers. Known types of fluid dispensers can suffer from a variety of problems: dripping after closure is an example of a problem, as is venting outside air into the container to permit better fluid flow.

Consequently, there remains a need for a fluid dispenser that does not drip after closure and/or is vented to outside air to permit better fluid flow.

Without limiting the scope of the invention a brief summary of some of the claimed embodiments of the invention is set forth below. Additional details of the summarized embodiments of the invention and/or additional embodiments of the invention may be found in the Detailed Description of the Invention, below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a front push tap dispenser has a flow configuration and a sealed configuration. The front push tap comprises a tap body, a spring button member and a valve seal member. The spring button member and valve seal member are connected by a flexible stem having two ends, each end connected to the spring button member and the valve seal member. When in the sealed configuration the spring button holds the flexible stem and the valve seal member so the valve seal member is sealingly engaged to the inner wall of the dispensing port. When in the flow configuration the spring button is depressed, which causes the flexible stem and the valve seal to move downwardly to unseal the dispensing port to allow fluid to be dispensed. When the spring button is released, it elastically springs back to the undepressed position, causing the valve seal member to sealingly engage with the inner wall of the dispensing port. The spring body is is sealingly connected to the tap body In some embodiments the tap body is connected to a container with a threaded end. However, the tap body can be connected to a container by snapping it on the container or a press cork style seal can also be utilized. The container can either be rigid, flexible or a bag in box type container.

The tap body can be made of ethylene or propylene, while the spring button can be made of a thermoplastic elastomer.

The front push tap dispenser can also include a tamper evidence cap which has a spring button covering portion which is sealingly engaged to the tap body to cover the spring button and which has a dispensing port covering portion which is sealingly engaged to the dispensing port, the spring button covering portion and the dispensing port covering portion being flexibly connected to each other.

The front push tap flexible stem can extends in a curved path so the two ends of the flexible stem are angled relative to each other, for example between 60° and 135° with one embodiment being at approximately 90°.

The front push tap can also allow outside air to be vented into the front push tap when the front push tap is in the flow configuration, to improve the flow and prevent glugging.

In one embodiment the venting is comprised of a vent passageway and a vent plug which is attached to the flexible stem so that when the flexible stem is in the sealed configuration, the vent plug sealingly fills the vent passageway, preventing outside air from reaching the fluid flow passage, and when the flexible stem is in the flow configuration, the vent plug is moved with the flexible stem to unseal the vent passageway, allowing outside air to pass through the vent passageway to reach the fluid flow passage.

In another embodiment the venting is comprised of a vent passageway and a duck bill vent which is connected to a molded channel which is connected to the vent passageway to permit outside air to pass through the vent passageway to reach the fluid flow passage when the front push tap is in the flow configuration.

Another embodiment has no venting, but is otherwise similar to the first embodiment.

An advantage provided by the disclosed embodiments is that the front push tap spring button is positioned forward of the dispensing port, which makes the tap easier to use.

The spring button has a bottom edge which has a shape selected from the group consisting of circular, oval, square, rectangular, hexagonal, octagonal, or in the shape of any other suitable polygon. The bottom edge of the spring button can also be thicker to assist in providing a good seal to the tap body.

The dispenser port has a bottom section which has a shape selected from the group consisting of circular, oval, square, rectangular, hexagonal, octagonal, or in the shape of any other suitable polygon, and further wherein the valve seal member shape is compatibly shaped to sealingly fit within the inside of the dispenser spout.

BRIEF DESCRIPTION OF THE DRAWINGS

FIG. 11 shows a another embodiment of the front push tap dispenser without venting.

DETAILED DESCRIPTION OF THE INVENTION

Figure 1:
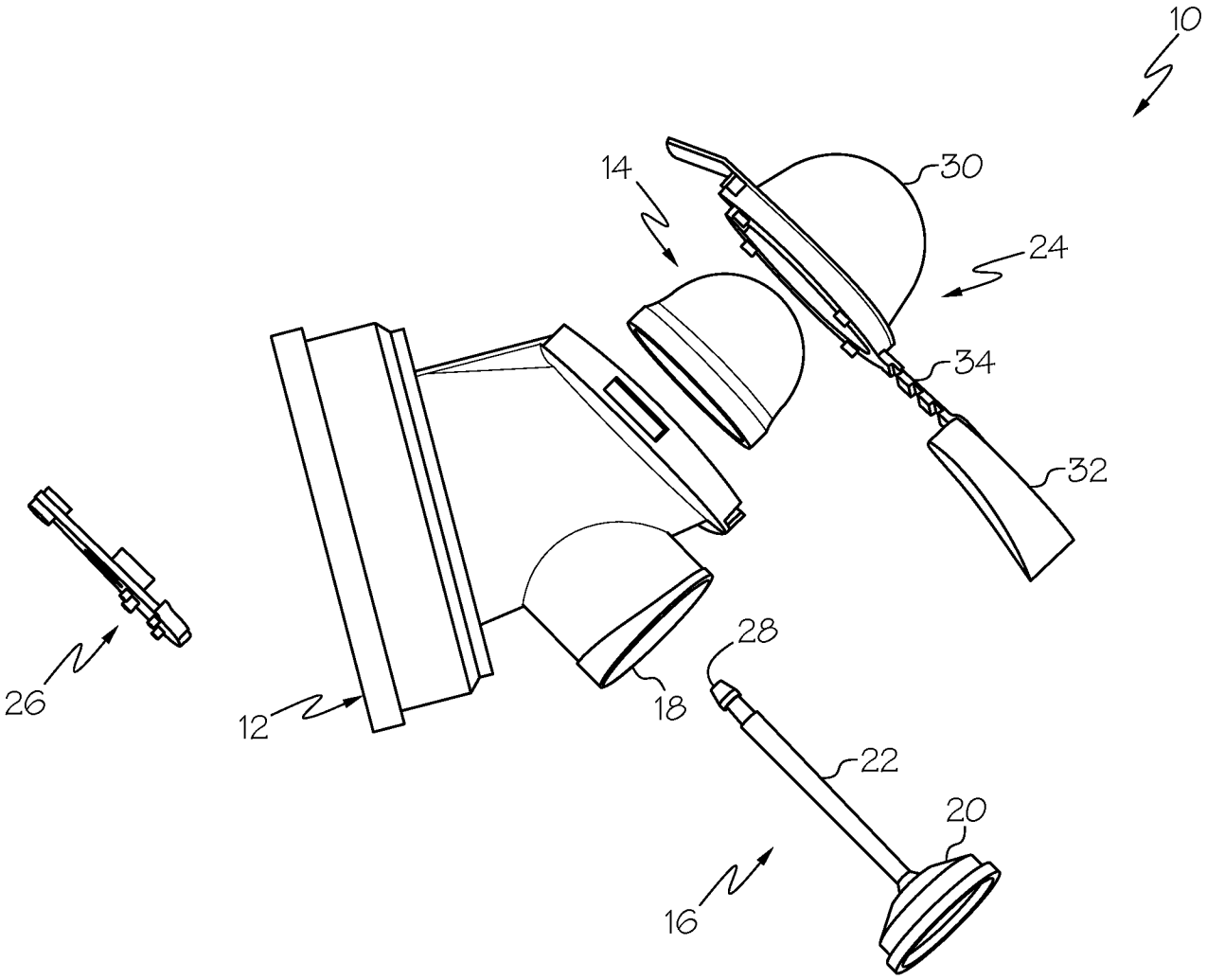
FIG. 1 shows an exploded view of the parts of a first embodiment of the front push tap dispenser.

Referring to FIG. 1, an exploded view showing the parts of a vented embodiment of the front push tap dispenser is shown generally at 10. The tap body is shown at 12, and is a molded plastic part made of ethylene or propylene. The spring button is made from a thermoplastic elastomer and is designed to elastically spring back to its unpressed position after being pressed and released. A valve member is shown at 16 and is comprised of a flexible stem 22 and a seal member 20, which is designed and sized to frictionally seal to an inner wall of the dispenser spout 18. As will be shown in more detail later, the flexible stem 22 attaches to the spring button 14 and when the spring button 14 is in its normal unpressed position, the seal member 20 sealingly fits inside the dispenser spout 18, preventing the flow of liquid. When the spring button 14 is pressed, it causes the flexible stem 22 to move downwardly, causing the seal 20 to move out of contact with the inner wall of the dispenser spout 18, allowing liquid to flow from the dispenser. A tamper evidence cap is shown at 24 and a vent is shown at 26.

Figure 2:
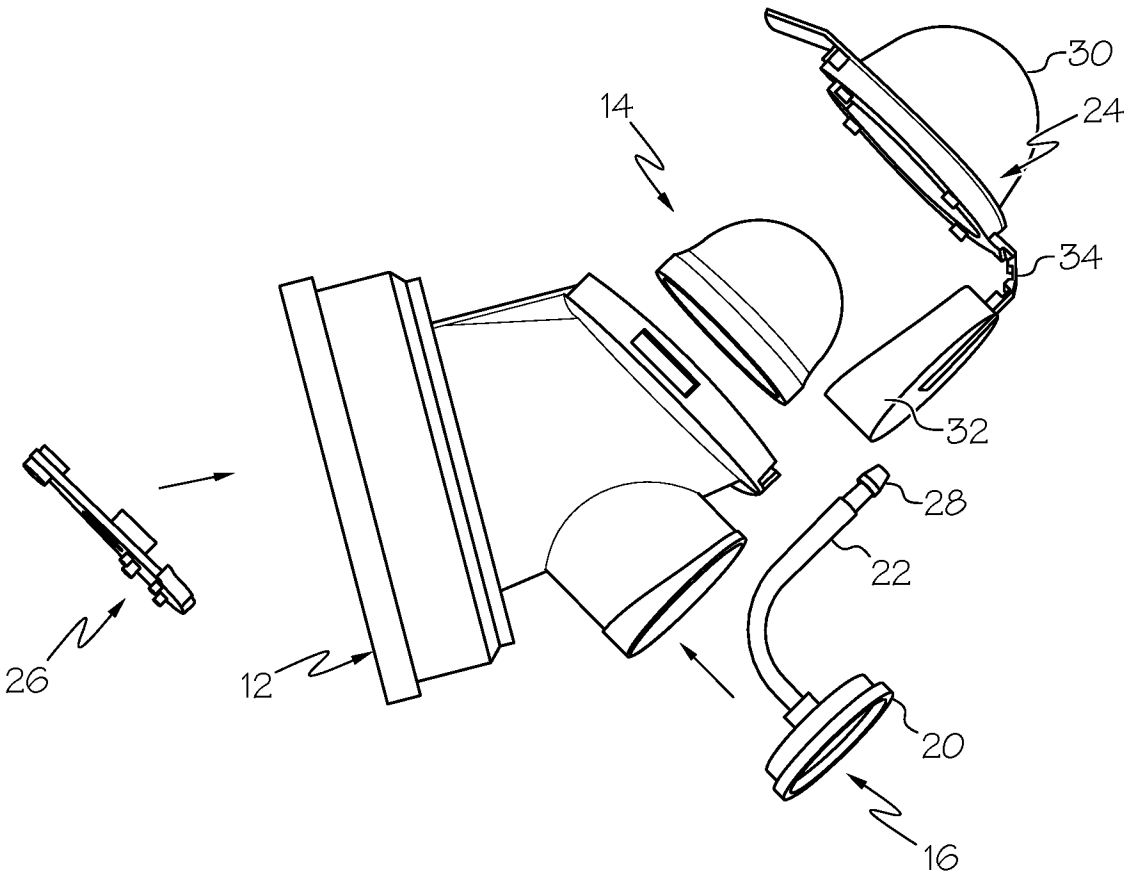
FIG. 2 shows how the parts of FIG. 1 are assembled.

Referring to FIG. 2, the assembly of the vented embodiment of the front push tap dispenser is shown. The valve stem 22 is inserted up through dispenser spout 18 and bent around a curved surface to connect to the spring button 14. The vent 26 is inserted through the opening in the back of the tap body 12 and connected to the valve stem 22. Once the valve 16 and vent 26 are in position, the spring button 14 is inserted and connected to the button latch 28. A support block behind the vent 26 keeps the valve 16 in position during button latching (discussed further below). The tamper cap 24 is pressed over the button and latched to the tap body 12. There is a square plug (discussed below) on the tamper cap which gets pressed into the body vent area (see FIG. 4). The vent plug seals the product during transit and while the product is on the shelf. The tamper cap 24 has a button portion 30, a spout portion 32 which are both connected by a flexible connector 34. The spring button 14 is sealingly connected to the tap body 12 as disclosed in application Ser. No. 15/313,296, filed Nov. 22, 2016, which is a national stage of PCT application no. PCT/US2015/31926, filed May 21, 2015, the entire contents of both of which are hereby incorporated by reference. In FIGS. 1 and 2, spring button 14 is shown with a circular base. However, other shapes and configurations are also contemplated, for example, the base can also be square, rectangular, hexagonal, octagonal, or in the shape of any other suitable polygon. In some embodiments, the cross-section of material is thicker at the base of the spring button 14 than nearer its peak. It should also be understood that valve seal member 20, which is shown as being circular, could also be other shapes, such as oval, square, rectangular, hexagonal, octagonal or any other desired shape, designed to matingly seal to a compatible shape of spout 18.

Figure 3:
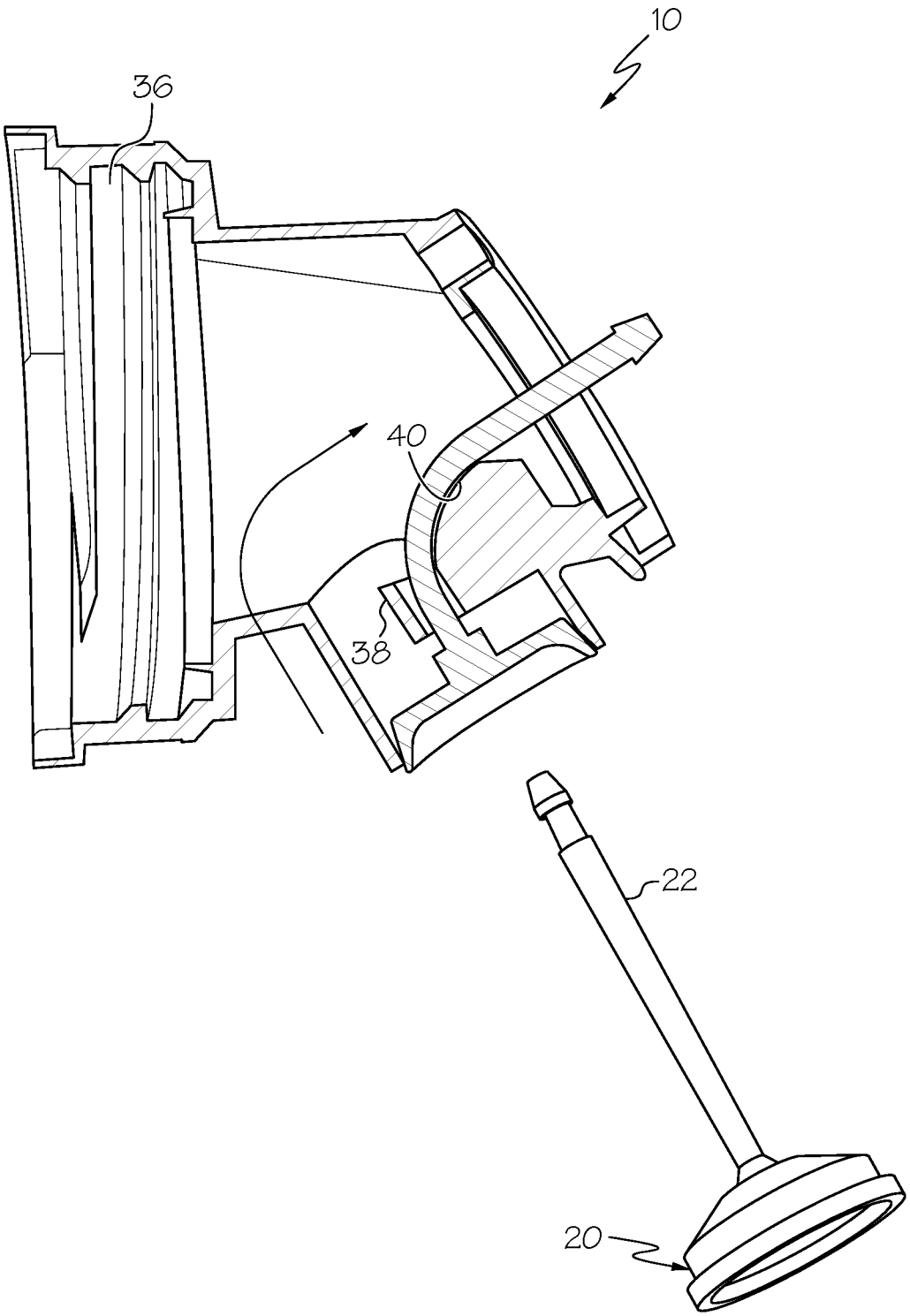
FIG. 3 shows a cutaway view of the tap body showing the valve stem and valve seal.
Figure 4B:
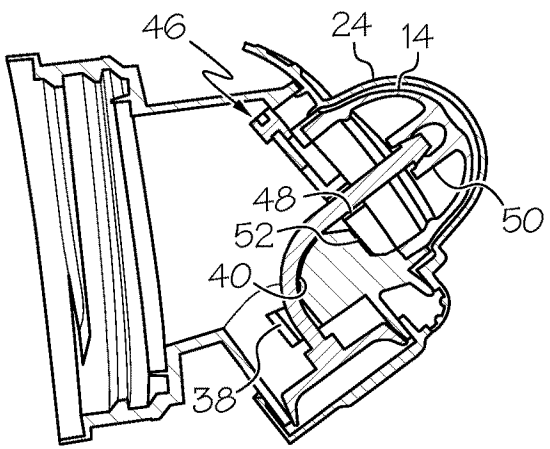
FIG. 4 shows a cutaway view of the vent.
Figure 4D:
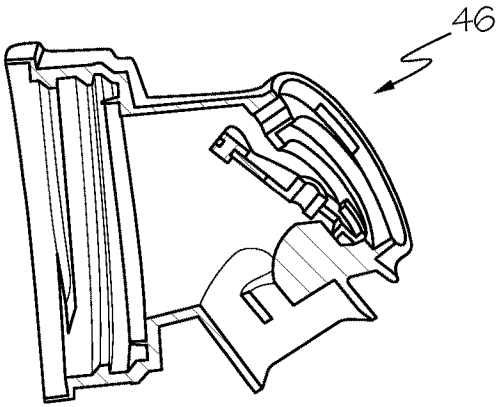
Figure 4A:
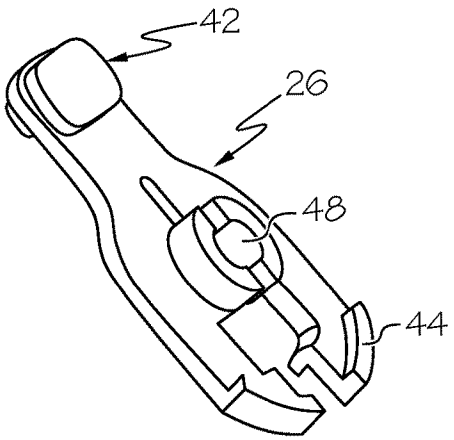
Figure 4C:
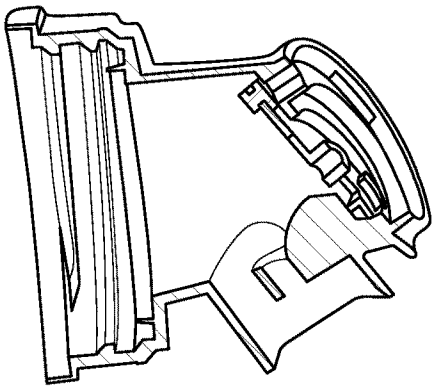

Referring to FIG. 3, a cross-sectional view of the tap 10 is shown. In this embodiment the tap body has a threaded end 36 for connection to the container, with a 33 mm thread being provide. It should be understood that any size thread could be used and other attachment methods are discussed further below. The threaded end 36 provides a fluid flow passageway which leads to dispenser spout 18. Valve 16 is shown in the sealed position with the flexible stem 22 guided through spout channel 38, around curved surface 40 with the button latch end 28 extending outside the portion of the tap body 12 to which the spring button 14 is sealingly connected. It should be noted that with this embodiment, the spring button actuator 14 is positioned at the forward end of the tap body 12, while the valve 16 seals at the exit or terminal orifice, the dispenser spout 18. The button seal 14 is an orifice seal, rather than an inside seal, which provides less post drip and less drying of the product around the orifice. Another advantage of this embodiment is that the activation of the spring button 14, by depressing it, is used to activate the valve 16, so that spring button 14 performs several functions. Spring button 14 performs the functions of actuator for the valve, vent activator, return spring button for the valve, forms a seal between the tap body and the outside environment, and provides an auto shut off feature, in that the spring button automatically un-depresses when released, which automatically causes valve 16 to close and seal. The spring button 14 is designed to mechanically depress enough to open the valve 16 in the open position, but to provide enough return force to reliably close valve 16 when spring button 16 is released. The valve 16 is molded straight, then assembled on the curve surface 40 and latched to the spring button 14. Over time the valve stem 22 takes this curved "set" and remains curved. One unique feature about the stem 22 remaining curved is that while dispensing the valve stem 22 follows that curve 40 and moves forward in the dispense snout. When product is being dispensed the valve seal portion 20 moves out of the flow of the product, due to the curve.

Figure 5B:
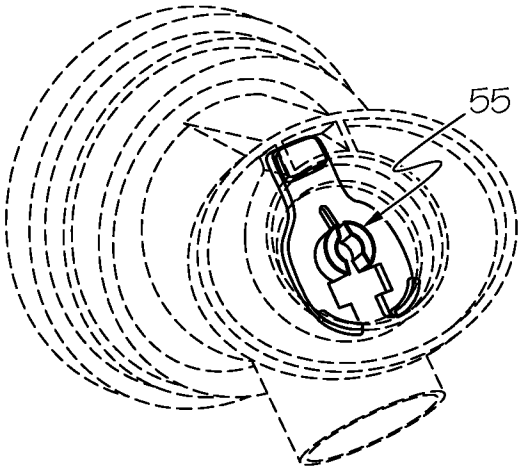
FIG. 5 shows how the vent attaches to the valve stem.
Figure 5C:
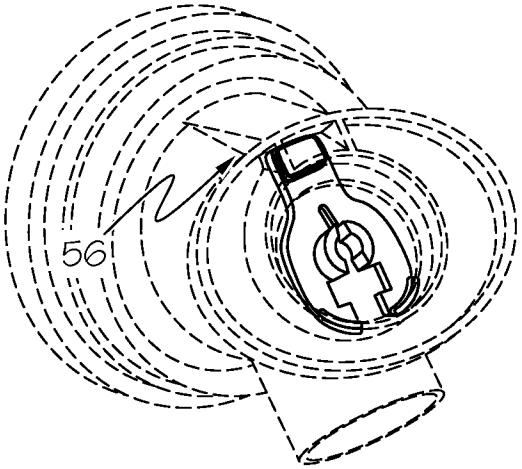
Figure 5A:
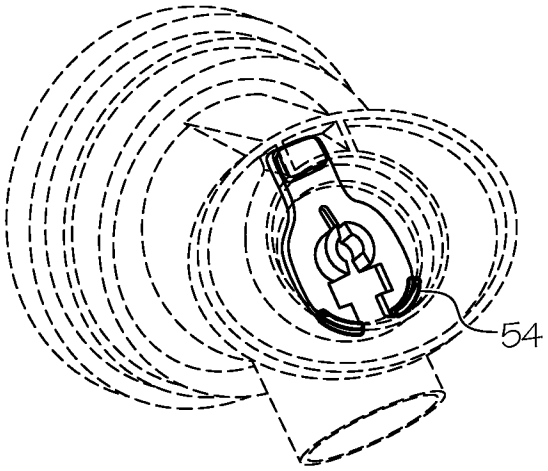
Figure 6B:
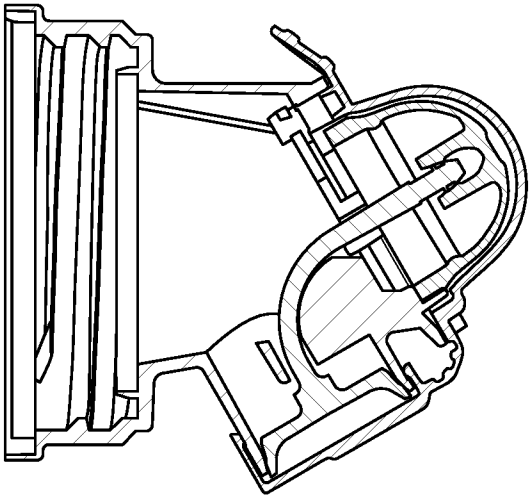
FIG. 6 shows various drawing views of the inventive front tap dispenser.
Figure 6A:
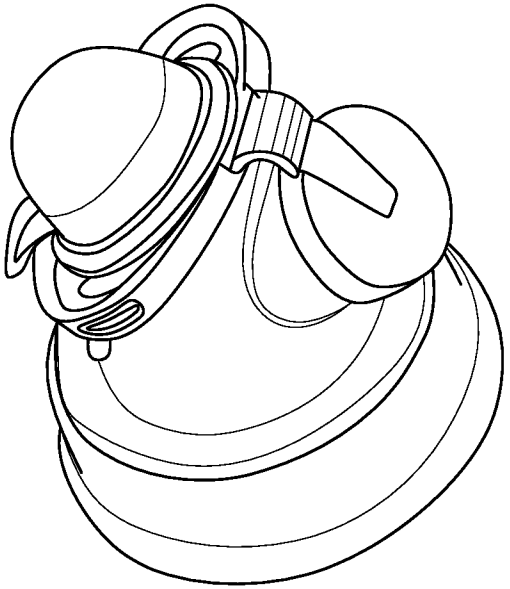
Figure 6D:
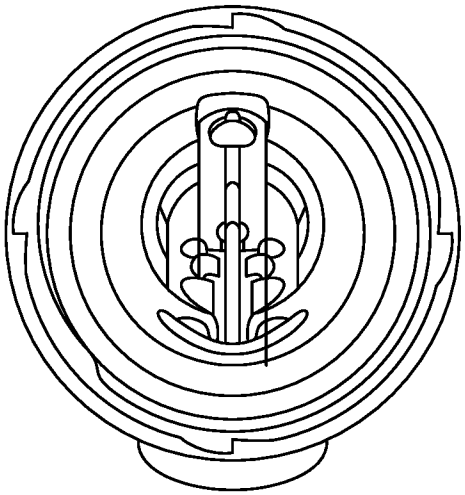
Figure 6C:
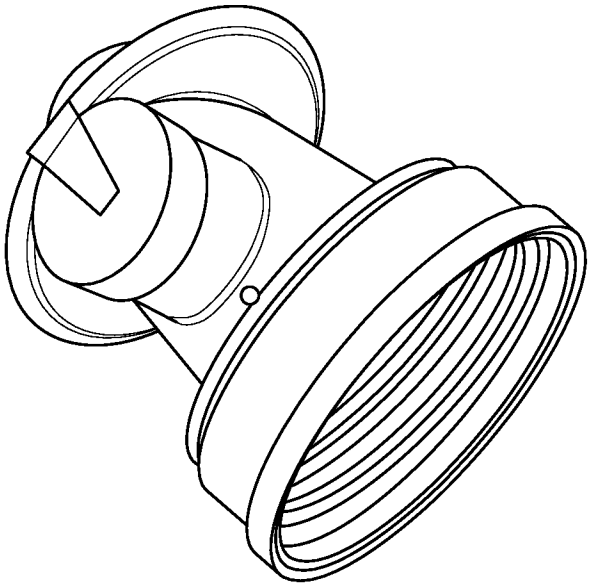
Figure 6F:
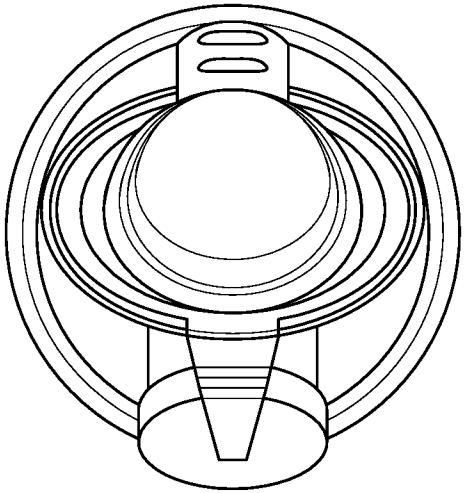
Figure 6E:
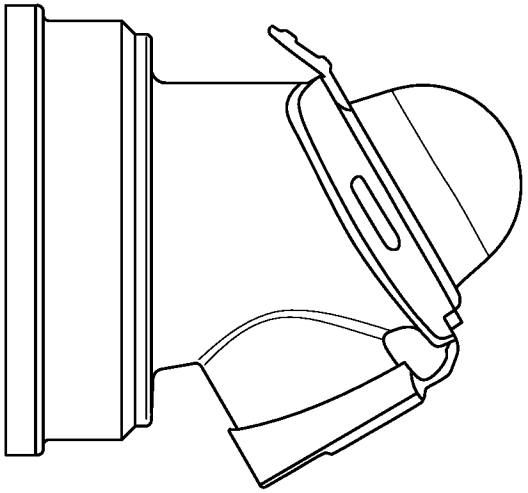
Figure 6H:
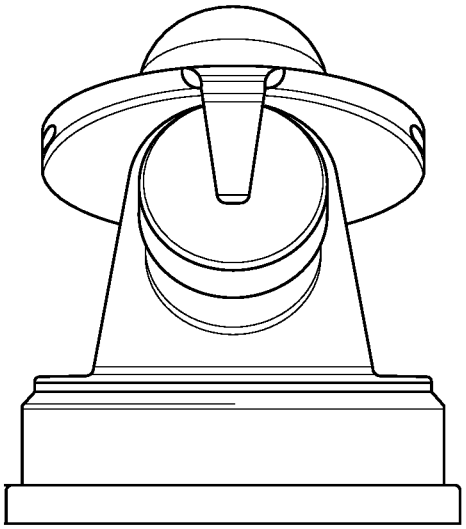
Figure 6G:
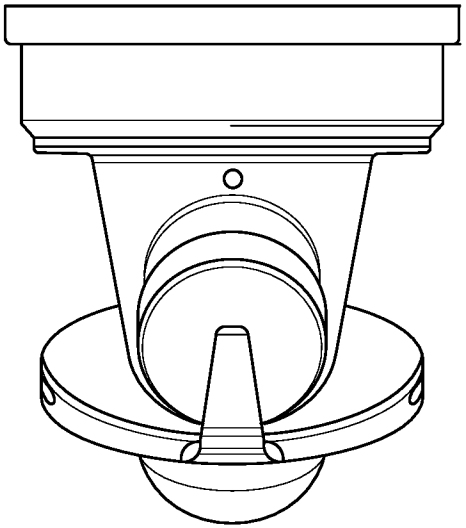
Figure 61:
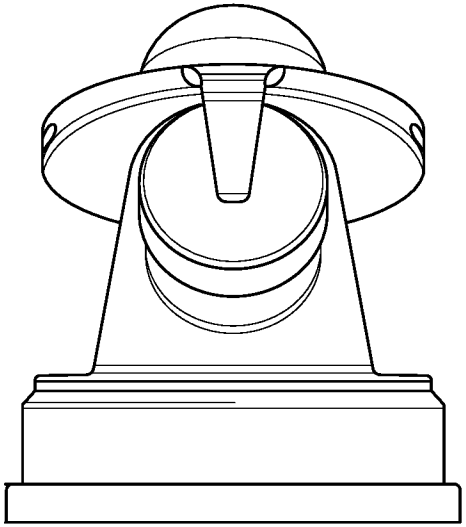

Referring to FIG. 4, the vent 26 is shown in more detail. Vent 26 is made of polypropylene based resin, or could be made of a more rigid material such as ABS resin, acetal, or nylon and includes a plug 42 made of TPE resin, a very low durometer material (close to silicone and classified as "extra soft"). When installed into the tap body, the latch area 44 interferes with the tap body 12 to create a preload which biases the plug 42 against the tap body 12 and hold the plug 42 in the vent passageway 46. The vent is snap fitted to and around flexible stem 22 at 48. The button latch 28 snaps into the button latch receiver 50 to attach the spring button 14 to the valve 16. The area of the tap body which receives the latch area 44 is shown at 52. The vent 26 is shown in the open position in FIG. 4*d*. Vent 26 can be adjusted in size to increase or decrease air return. Vent 26 can be Referring to FIG. 5, the latch area is shown at 54 of 5*a*. The button interface is shown at 55 of 5*b*. The plug in the vent passageway is shown at 56 of 5*c*.

Referring to FIG. 6, the assembled vented dispenser tap is shown, with a series of drawing views 6*a*-6*i*, showing the invention from different views.

Figure 7B:
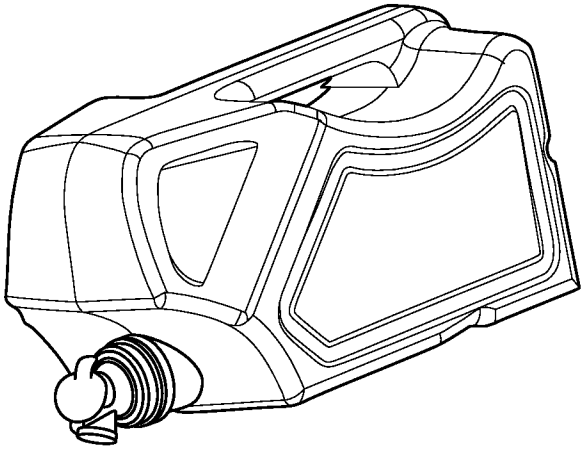
FIG. 7 shows the inventive front push tap dispenser attached to several different containers.
Figure 7C:
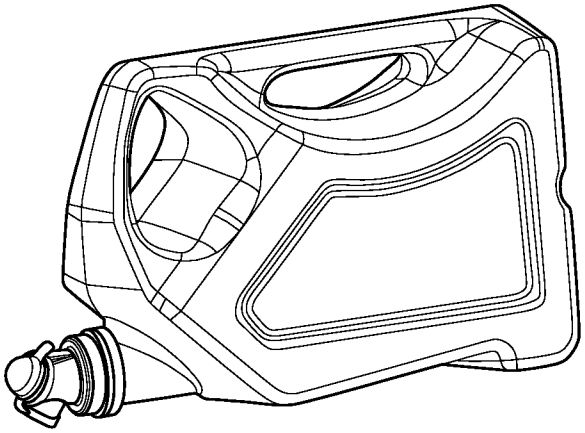
Figure 7A:
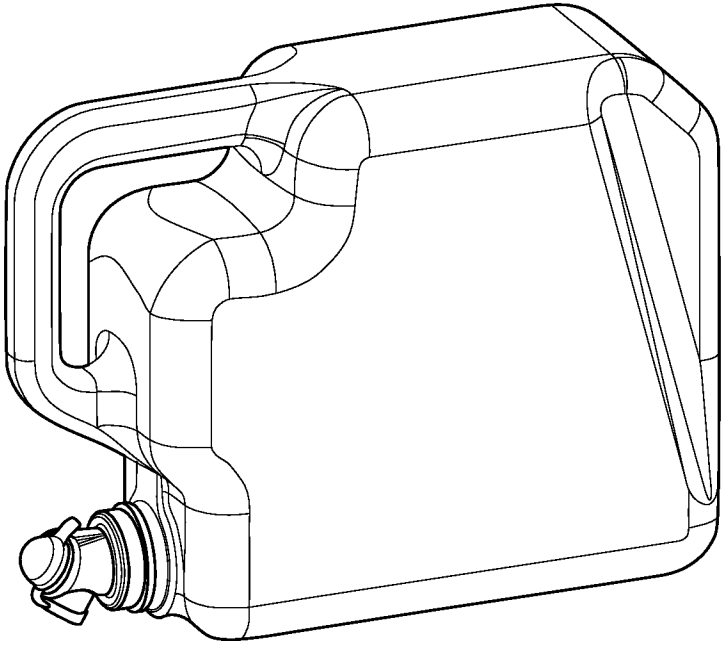

Referring to FIG. 7, the dispenser 10 is shown attached to various containers. The front push tap dispenser 10 can be used with rigid containers, flexible containers or the bag in box type container.

Figure 8:
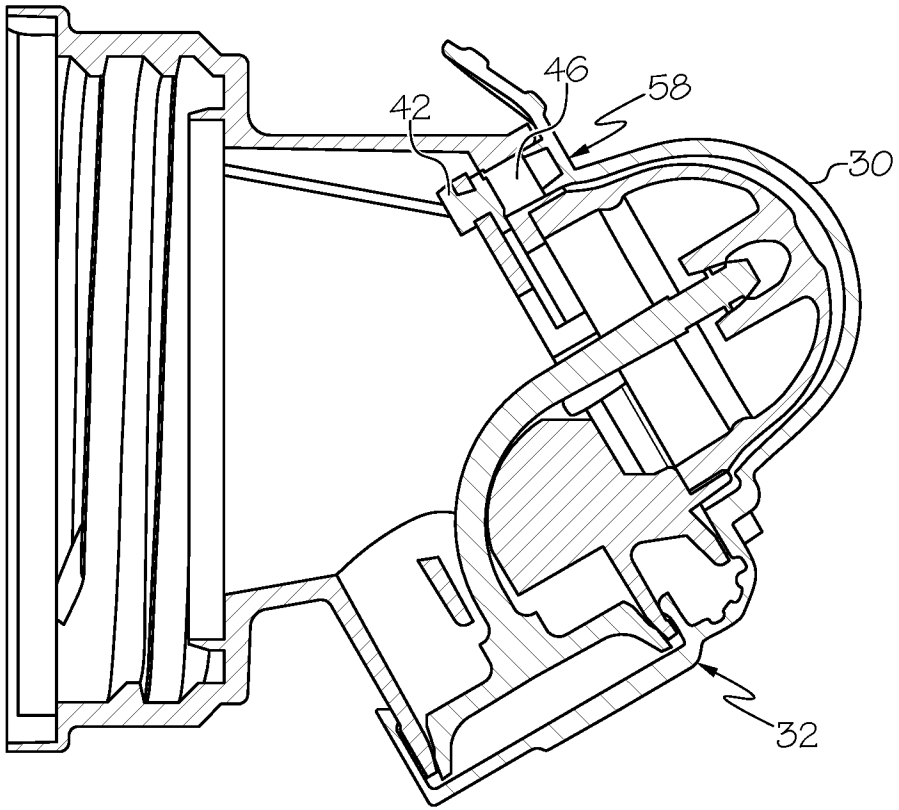
FIG. 8 shows a cutaway view showing the tamper cap and shipping plug inserted into the tap body and a portion of the tamper cap snapped over the dispense snout.

Referring to FIG. 8, the vent passageway 46 is shown with vent 26 in the closed position, and vent plug 42 sealingly engaged with vent passageway 46 to prevent leaking. Tamper cap plug 58 is also shown inserted into vent passageway 46, for transport and shelf use. The button portion 30 of tamper cap 24 is shown attached over button 14 and the spout portion 32 is shown snapped into place over the dispenser snout spout.

Figure 9B:
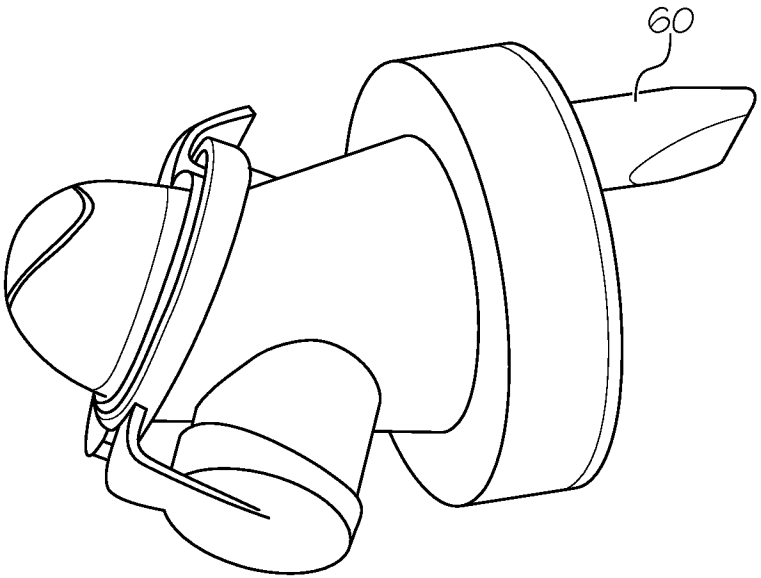
FIG. 9 shows a duck bill venting embodiment of the inventive front push tap dispenser.
Figure 9A:
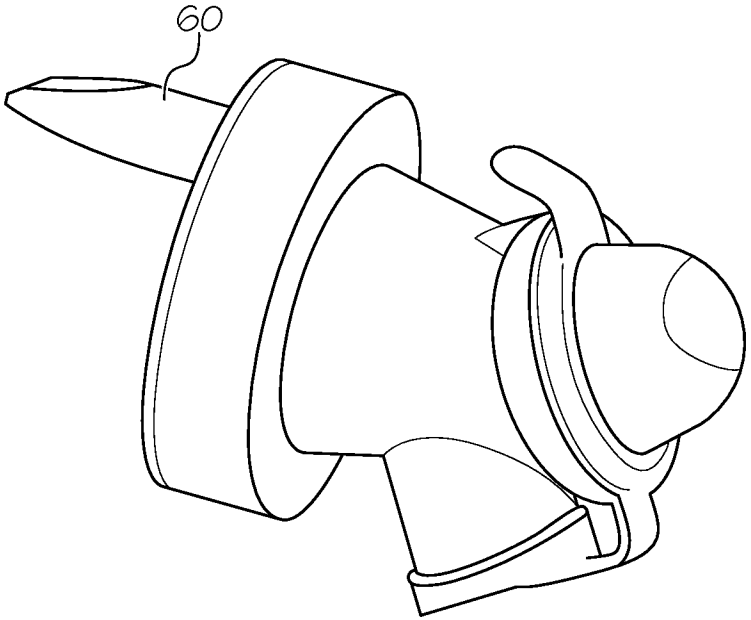

Referring to FIG. 9, an alternate embodiment is shown with a duck bill vent 60 in place of vent 26.

Figure 10B:
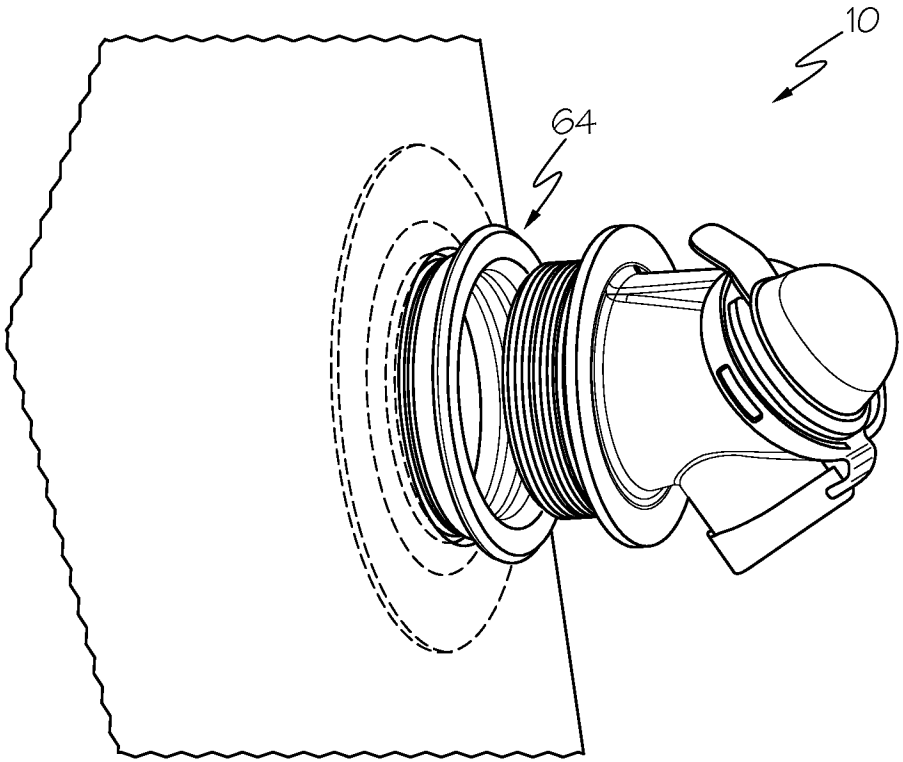
FIG. 10 shows a snap interface embodiment for connecting the tap body to a container.
Figure 10A:
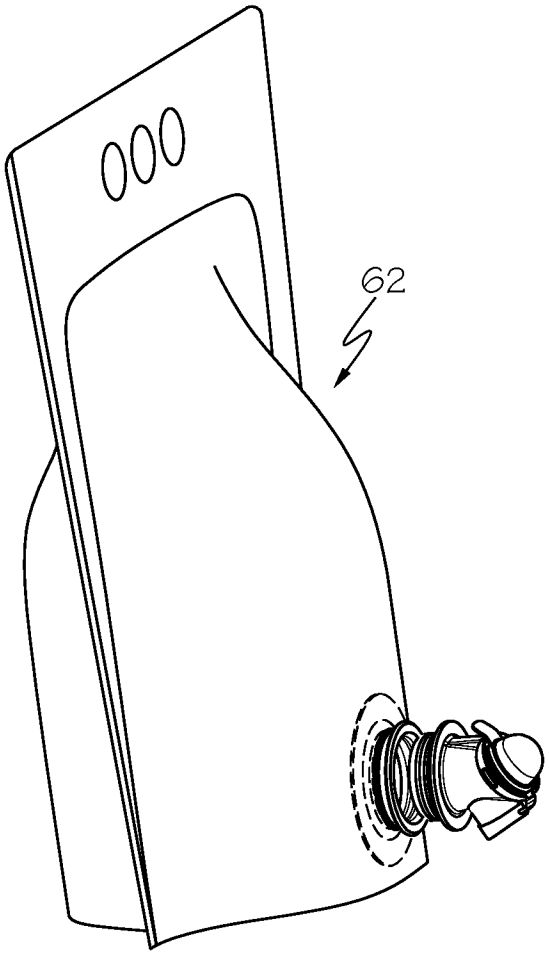

Referring to FIG. 10 a Snap interface is shown for a flexible bag or bag in box type of container 62. The dispenser 10 snaps into gland 64, which is provided in the bag 62. The dispenser snaps into the bag and provides a lock at full insertion.

Referring to FIG. 11, a non-vented version of the inventive front push tap dispenser is shown, which has the vent passageway 46 filled and does not have a vent structure 26. The non-vented version is contemplated to be used with non-rigid or flexible containers, or bag in box type containers.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A front push tap having a flow configuration and a sealed configuration, the front push tap comprising:

a tap body, the tap body having an end for attachment to a container, the end having a fluid flow passage therethrough which is fluidly connected to a dispensing port, the dispensing port having an inner wall;

a spring button member, which is sealingly connected to the tap body;

a valve seal member;

a flexible stem having two ends, one end of the flexible stem connected to the valve seal member and the other end of the flexible stem connected to the spring button member; wherein, when the front push tap is in the flow configuration, the spring button member is depressed, causing the valve seal member to move downwardly to unseal the dispensing port to allow fluid to be dispensed, and when the front push tap is in the sealed configuration the spring button member is undepressed and the valve seal member is sealingly engaged to the inner wall of the dispensing port to prevent the flow of fluid from the dispensing port, wherein the flexible stem extends in a curved path so the two ends of the flexible stem are angled relative to each other.

2. The front push tap of claim 1 wherein the end is threadably connected to the container.

3. The front push tap of claim 1 wherein the end is snapped to the container.

4. The front push tap of claim 1 wherein the end is a cork style seal press on attachment to the container.

5. The front push tap of claim 1 wherein the container is selected from the group consisting of a rigid container, a flexible container and a bag in box container.

6. The front push tap of claim 1 wherein the tap body is made of ethylene or propylene.

7. The front push tap of claim 1 wherein the spring button is made of a thermoplastic elastomer.

8. The front push tap of claim 1 further including a tamper evidence cap which has a spring button covering portion which is sealingly engaged to the tap body to cover the spring button and which has a dispensing port covering portion which is sealingly engaged to the dispensing port, the spring button covering portion and the dispensing port covering portion being flexibly connected to each other.

9. The front push tap of claim 1 wherein the angle is between 60° and 135°.

10. The front push tap of claim 9 wherein the angle is 90°.

11. The front push tap of claim 1 wherein the outside air is vented into the front push tap when the front push tap is in the flow configuration.

12. The front push tap of claim 1 further including a vent passageway and a vent plug which is attached to the flexible stem so that when the flexible stem is in the sealed configuration, the vent plug sealingly fills the vent passageway, preventing outside air from reaching the fluid flow passage, and when the flexible stem is in the flow configuration, the vent plug is moved with the flexible stem to unseal the vent passageway, allowing outside air to pass through the vent passageway to reach the fluid flow passage.

13. The front push tap of claim 1 further including a vent passageway and a duck bill vent which is connected to a molded channel which is connected to the vent passageway to permit outside air to pass through the vent passageway to reach the fluid flow passage when the front push tap is in the flow configuration.

14. The front push tap of claim 1 wherein the spring button is positioned forward of the dispensing port.

15. The front push tap of claim 1 wherein the spring button has a bottom which has a shape selected from the group consisting of circular, oval, square, rectangular, hexagonal, octagonal, or in the shape of any other suitable polygon.

16. The front push tap of claim 1 wherein the dispenser port has a bottom which has a shape selected from the group consisting of circular, oval, square, rectangular, hexagonal, octagonal, or in the shape of any other suitable polygon, and further wherein the valve seal member shape is compatibly shaped to sealingly fit within the inside of the dispenser spout.

17. A front push tap having a flow configuration and a sealed configuration, the front push tap comprising:

a tap body, the tap body having an end for attachment to a container, the end having a fluid flow passage therethrough which is fluidly connected to a dispensing port, the dispensing port having an inner wall;

a spring button member, which is sealingly connected to the tap body;

a valve seal member;

a flexible stem having two ends, the flexible stem extending in a curved path, and with one end of the flexible stem connected to the valve seal member and the other end of the flexible stem connected to the spring button member;

wherein, when the front push tap is in the flow configuration, the spring button member is depressed, causing the valve seal member to move downwardly, in the curved path, to unseal the dispensing port to allow fluid to be dispensed, and when the front push tap is in the sealed configuration the spring button member is undepressed and the valve seal member is sealingly engaged to the inner wall of the dispensing port to prevent the flow of fluid from the dispensing port, wherein the flexible stem extends in a curved path so the two ends of the flexible stem are angled relative to each other.

* * * * *